United States Patent [19]

Whellams

[11] Patent Number: 4,632,156

[45] Date of Patent: Dec. 30, 1986

[54] SKEINING APPARATUS

[75] Inventor: Geoffrey E. Whellams, Teeside Airport, Great Britain

[73] Assignee: Roberts Industries, Marine City, Mich.

[21] Appl. No.: 798,894

[22] Filed: Nov. 18, 1985

Related U.S. Application Data

[63] Continuation-in-part of Ser. No. 633,845, Jul. 24, 1984.

[51] Int. Cl.[4] ..... B65H 54/56

[52] U.S. Cl. ..... 140/92.1; 28/291; 140/102; 242/53

[58] Field of Search ..... 242/53; 140/102, 104, 140/149, 92.1, 71 R; 28/291

[56] References Cited

U.S. PATENT DOCUMENTS 2,246,608 6/1941 Taylor et al. ..... 28/291

4,511,094 4/1985 Kent ..... 242/53

FOREIGN PATENT DOCUMENTS 2213917 9/1973 Fed. Rep. of Germany ..... 242/53

*Primary Examiner*—Lowell A. Larson

*Attorney, Agent, or Firm*—Burton, Parker & Schramm

[57] ABSTRACT

A skeining machine has a looping member arranged to move in an elongated endless track having recurvate ends with a pair of looping needles arranged within said path to have a filament looped thereon during revolution of the looping member about the path with one of the needles being a spinner needle mounted on a rotatable shaft at an acute angle extending away from the other needle, and the spinner needle being disposed adjacent one of the recurvate ends of the looping member path and having the root of the connection between the spinner needle and the rotatable shaft on which it is mounted being disposed between the path of movement of the looping member and the center of recurvature of the looping member path.

10 Claims, 11 Drawing Figures

52
94
W
50
C
W1
68
36
30
W2
32
W3
34
64
96
66
62
54
R
A
D
C'
40
42
32a
32b
W5
W6
W7

SKEINING APPARATUS

RELATED APPLICATIONS

This application is a continuation-in-part of application Ser. No. 633,845 filed July 24, 1984, which is incorporated herein by reference.

DESCRIPTION

1. Field of Invention

This invention relates to skeining apparatus - that is to say, apparatus arranged to operate on a filament so as to form a twisted skein therein, intermediate the ends of the filament but without severing the filament. The term "filament" is intended to cover single or multi-strand metal, such as copper wire, or natural or synthetic fiber strands.

2. Background of Invention

In the aforesaid application a skeining apparatus forms loops by moving an eyelet, through which the filament extends, around an elongated endless track encircling a pair of looping needles or pins, and when the proper number of loops have been wound on the needles, looping movement of the eyelet is interrupted and one of the needles spins the bundle of loops to form the skein. Then the filament with skein attached is pulled off the needles.

While satisfactory skeins can be made by the apparatus of the aforesaid application, it is desirable to be able to increase the skeining speed without concommitantly increasing filament breakage. There has also been the need to facilitate threading up of the skeiner by having those parts through which the filament must be threaded fall into alignment so that the filament may be passed therethrough simply and easily.

Experimentation has indicated that limitations on speed of skeining are directly related to the introduction of slack in the filament during looping about the needles preparatory to twisting the loops into a skein. Means for taking up slack in the filament have involved the use of tensioning arms or the like whose moments of inertia must be overcome by the relatively fragile filament as it suddenly accelerates during looping around the needles. For example, in the tensioner shown in the aforesaid application, the filament is fed through a slack take-up arm which is biased by a direct current motor so that when slack in the filament occurs the path of the filament is deflected between a pair of filament guides and the slack thereby taken up. Thereafter, when the filament is suddenly accelerated during looping of the filament around the needles, there is no slack to cause a sudden jerk and breaking of the filament. On the other hand, when the filament suddenly accelerates during the looping motion, the inertia introduced by the mass of the take-up arm and the motor armature, must be overcome in order for the take-up arm to move back to a position where it does not deflect the filament from its path between the filament guides preparatory to taking up the slack during continued looping movement of the eyelet. Such mass limits the acceleration rate of the filament to prevent breakage and accordingly the speed of looping the filament about the needles. In addition, each time the looping eyelet makes a complete cycle around the looping needles, whatever slack occurs should be taken up to minimize jerking. As the speed of the eyelet is increased, the cycle time can become so short that the inertia of the take-up arm and motor armature may not permit these parts to respond quickly enough to take up the slack and breakage through jerking of the filament may occur. Thus, our experimentation has indicated that, among other things, the speed of skeining is limited by the problems involved as slack is introduced into the filament during looping on the needles.

SUMMARY OF THE INVENTION

To overcome this problem, the skeiner has been redesigned to minimize the introduction of slack into the filament during the looping operation. This has been accomplished by moving the root of the spinner needle forward of the center of recurvature of the looping element, i.e., beyond the center measured from the filament source eyelet. As a result, the introduction of slack is minimized and the need for filament take-up is substantially reduced. By substantially reducing the introduction of slack into the filament during looping thereof about the skeining needles, any take-up mechanism may be made of extremely lightweight mass so that little inertia will be introduced into the system and, accordingly, skeining speed may be increased.

Advantageously, the looping element comprises an eyelet which is disposed in alignment with the filament source eyelet when the skeining apparatus is idle so that filament drag through the skeiner during coil winding is minimized.

There is also disclosed an improved wire take-up mechanism in which the length of the take-up arm is shortened and the inertia of the motor armature is removed from the system so that it is not a factor.

There is also disclosed a filament tensioning device which permits different tension levels.

Improvements are also disclosed for positioning the spinner hook in the correct position for filament looping in making up the skein. Such improvements include the use of a direct current motor for driving the spinner hook and imposing on the motor an alternating current causing it to oscillate and position the needle in the proper position for looping.

BRIEF DESCRIPTION OF PREFERRED EMBODIMENTS

Figure 1:
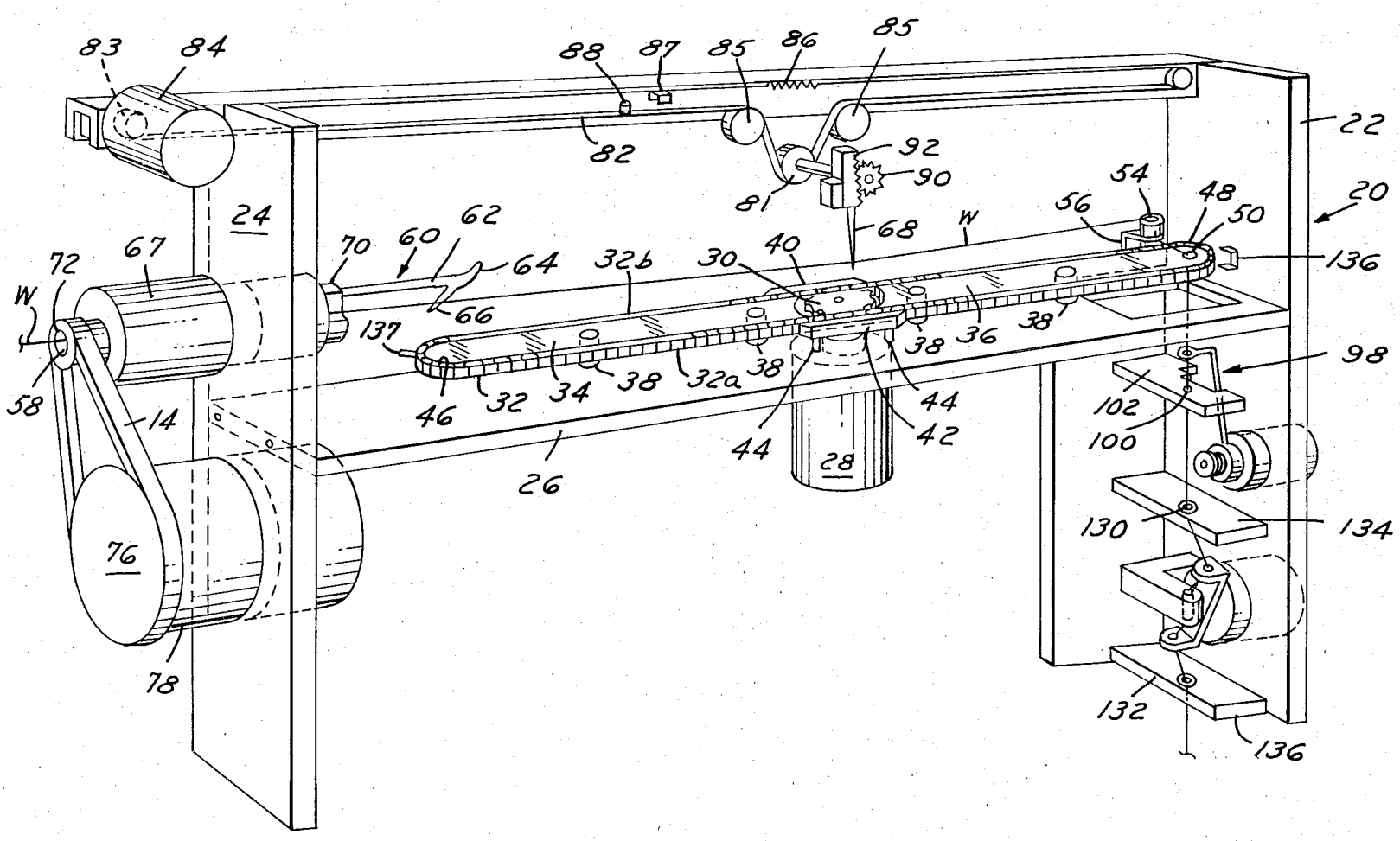
FIG. 1 is a diagrammatic general perspective view of the skeining apparatus embodying the invention.

Referring initially to FIG. 1, the apparatus there shown is intended for skeining insulated copper monofilament wire (sometimes herein referred to as simply "the filament"), such as is used in winding various types of coils. Though the apparatus may be used with wire of relatively heavy gauges, it is in fact primarily intended for use with wire of relatively fine gauges, down to 0.025 mm. (0.001 inch diameter).

The skeining apparatus is intended to be associated with a coil winding machine (not shown) and may include a framework 20 having a pair of end walls 22 and 24 between which extends a shelf 26 supporting a drive motor 28 whose shaft carries a drive sprocket 30 meshing at opposite diameters with the oppositely moving spans 32*a* and 32*b* of an endless drive member 32. The endless drive member may be in the form of a roller chain which is guided by guide members 34 and 36 supported on the shelf 26 by support members 38. Opposite the sprocket 30 where it engages the drive member 32, a pair of wear plates 40 and 42 are supported on the shelf by support members 44, as shown in FIG. 1, to keep the chain engaged with the sprocket.

The guide members 34 and 36 have a provided clearance within which the sprocket 30 may rotate as shown in FIGS. 1 and 3–5. The ends of the guide members are shaped as at 46 and 48 to provide recurvate ends (which are circular in the embodiment of FIGS. 1 and 3–5). At the end 48, the guide member 36 is provided with a filament source aperture 50 defined by a ceramic ferrule or eyelet 52, upwardly through which extends the wire W to be skeined.

Figures 2, 3, 4, 5:
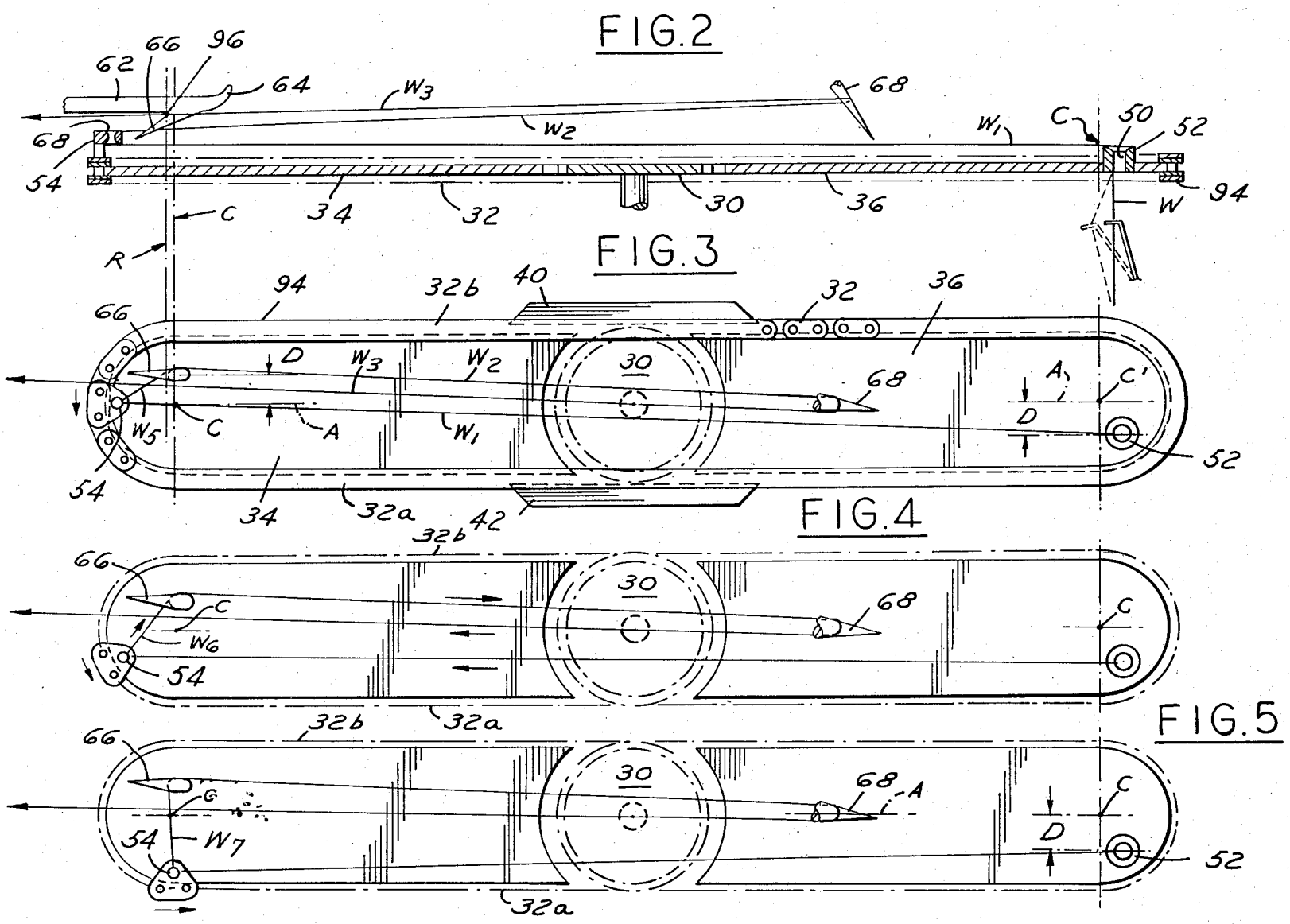
FIG. 2 is a side view of the looping apparatus, including the eyelt and needles of FIG. 1.
FIGS. 3, 4 and 5 are plan views of the apparatus depicted in FIG. 2 at various stages in the looping movement of the eyelet.

Mounted on the chain 32 is a looping member 54 in the form of an eyelet. The eyelet is carried by an L-shaped bracket 56, the vertical leg of which is secured to a link of the chain 32 and the horizontal leg carries the eyelet. Preferably the L-bracket is formed of a lightweight material such as aluminum, and the eyelet 54 is desirably a ceramic material to provide long wear. The looping member follows an elongated endless path having recurvate ends as best shown in FIGS. 3–5. Looping needles 60 and 68 are disposed within the track or path of the looping member.

The wire W, after leaving the aperture 50, extends up through the eyelet 54 and from there extends the length of the skeining mechanism, past the needles 60 and 68, and passes out of the skeiner as through a bore 58 in the supporting mechanism for the spinner needle 60. The supporting mechanism for the spinner needle includes a needle shaft 62 whose free end is turned upwardly as at 64, and is provided with a downwardly and forwardly (i.e., away from the filament source eyelet 52) inclined needle 66 whose point is disposed below the upper surface 68 of the looping eyelet 54, whereby the loop $W_2$ of the wire will be picked up to form a loop between the needle 66 and the needle 68.

The root 96 of the needle is where it intersects at the inside of an acute angle with the shaft 62 and the filament is caught in the root for loop formation. The mechanism supporting needle 60 includes a bearing assembly 67 supported on end wall 24 and rotatably carrying a hub 70 from which the needle shaft 62 projects. The axis of the needle shaft 62 extends toward and intersects needle 68, as best shown in FIGS. 3–5. The hub 70 is provided with a sprocket 72 over which is entrained a cogged belt 14 which encircles a drive sprocket 76. Motor 78 is preferably a 12-volt DC permanent magnet, six pole motor which runs only in one direction full speed except when positioning needle 66. It is connected at a 6-to-1 ratio between drive sprocket 76 and spinner sprocket 72. When it is de-energized and fed a 50–60 cycle alternating current, it will tend to oscillate between two of its poles, and with the cogged belt 14 suitably adjusted on the sprockets, this will ensure that the needle 66 points downwardly as shown in FIGS. 1 and 2 in a position to receive the filament loops. Thus, the motor will serve to accurately locate the needle 66 for the looping operation. The motor 78 may be of the type shown in U.S. Pat. No. 4,393,344.

The second needle 68 is shown and described in connection with FIG. 4*b* of U.S. application Ser. No. 633,845, filed July 24, 1984. A toothed pulley 81 is driven by a cogged belt 82 passing partially therearound and partially around a motor pulley 83 provided on the output shaft of a direct current electric driving motor 84. The belt is constrained by idler pulleys 85 and the two ends of the belt are coupled together by means of a spring 86 adapted to maintain the correct tension in the belt. An inductive slotted detector 87 is cooperable with a peg 88 provided on the belt to allow detection of the "home" position of the needle 68. Motor 84 is preferably a 12-volt DC motor, and upon energization in one direction the pinion 90 is caused to rotate in mesh with the rack 92 to which the needle 68 is affixed to cause the needle 68 to be projected toward the guide plates 34 and 36 to a position somewhat as shown in FIGS. 1 and 2. The torque on pinion 90 causes the rack and needle assembly to be swung in a counterclockwise direction to the angled position best shown in FIG. 2 where further swinging is prevented by a stop (not shown). Thereafter, maintaining a voltage across the terminals of the motor 84 when in a stalled condition, will impart a bias to the needle 68 to urge the needle away from the spinner needle 66. This bias keeps the skein distended as the spinner motor 78 twists the skein, and the bias is such that as the skein shortens, the bias is overcome to permit the needle 68 to swing in a clockwise direction. When the proper number of twists have been effected in the skein, the polarity across motor 84 is reversed, causing the needle 68 to be retracted out of the skein and also causing the needle 68 to swing in a clockwise direction, thereby dropping the skein off the needles 66 and 68 and permitting the skein and the wire to which it is attached to exit out through the bore 58 of the spinner assembly and to move to the coil winding machine where the skein will become part of the coil being wound from the wire W. Further description and operation of the needle 68 will be found by reference to U.S. application Ser. No. 633,845, filed July 24, 1984.

The point of the second needle 68 when it is disposed in the position shown in FIG. 2, extends just below the wire W as it extends from the looping eyelet 54 through the bore 58 of the spinner needle assembly, so that as the loop 54 travels with the chain 32, it will cause the wire to be looped between the needle 68 and the needle 66. The action is best shown in FIG. 2 where the point of needle 68 is just above wire span $W_1$ but will intersect the span extending to the top and over the upper edge 68 of the looping eyelet on each cycle of the looping eyelet around its track.

We have found that the speed of skeining may be substantially increased by locating the root 96 of the needle 66, i.e., the apex of the acute angle between the needle and its shaft 62, as shown in FIGS. 3–5, forwardly of the center C of the recurvature track of the looping eyelet 54, or between the center C and the track, but closer to the center than the track. The term "forwardly" refers to the direction of movement of the wire W out of the source eyelet 52 and toward the wire exit from the skeiner. The displacement of the needle root 96 forwardly of the center C is indicated by the line R. As a result of this displacement of the spinner needle, the wire span $W_1$ does not go slack but rather remains under a light tension as the eyelet 54 recurves around the spinner needle. It will be noted from FIGS. 3, 4 and 5 that the wire spans $W_5$, $W_6$ and $W_7$ are progressively longer and that at no time during this movement of the eyelet around the recurvate end adjacent the spinner needle is slack introduced into the wire. Accordingly, it is not necessary for the take-up mechanism generally indicated at 98 in FIG. 1 to take up slack developing as the looping eyelet passes around the spinner needle, and as a consequence it has been found that the skeining operation may be substantially increased in speed without causing wire breakage.

It has also been found that threading up of the skeiner is simplified if the eyelet 52 is located directly below the looping eyelet 54 when the looping eyelet is in its "home" position. As a consequence, the wire may be threaded directly up through the eyelet 52 and through the looping eyelet 54. In order to effect this alignment, and minimize the introduction of slack into a filament being skeined, the eyelet 52 is disposed in alignment with the path of the looping element and is located before the looping element crosses the centerline A of the centers C and C' of the recurving track ends. The displacement of the eyelet 52 from the centerline A is indicated by dimension D in FIG. 3. Similarly, the spinner needle root 96 is displaced on the opposite side of such centerline A by the same distance D. Efficiency in skeining is improved by locating the eyelet 52 as shown in FIGS. 3–5, viz., before back dead center, i.e., before axis A, so that upon the initial movement of the looping eyelet 54 from registry with eyelet 52, a loop will be formed at the needle 68, rather than wasting a revolution of the looping eyelet to form the first loop.

Figure 6:
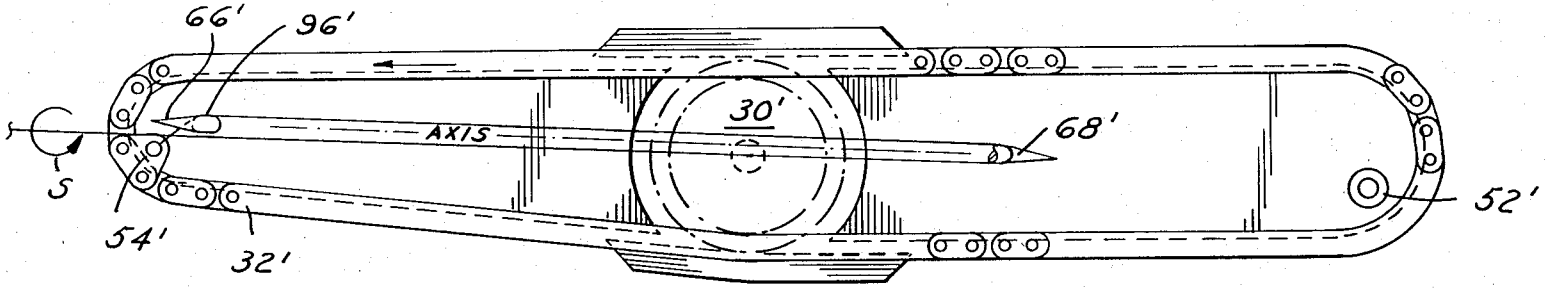
FIG. 6 is a plan view of an alternative form of the looping element path.

In FIG. 6 there is shown a modification of the path or track of the looping eyelet 54' to provide a tighter radius around the spinner needle 66' than around the filament source eyelet 52'. By reducing the radius of looping eyelet track movement around the spinner needle, pay-out of the wire is further reduced from that shown in the embodiment of FIGS. 1–5, inclusive. This design is made possible by driving the chain 32' by the central sprocket 30'. Thus, the radius of recurvature of the track ends is dissimilar in this embodiment. While each of the recurvate ends is shown to be found on a constant radius, it is feasible, using the center sprocket drive 30', to have recurvate ends of other than circular shape if such is found to be desirable for improved skeining operation.

In the embodiment of FIG. 6, it is desirable to keep the length of the spinner needle 66' as short as possible and to have the locus of the looping eyelet 54' pass as close as feasible to the root 96' of the spinner needle. It is also desirable to keep the axis of rotation of the spinner needle aligned with the second needle 68' to prevent a "skipping rope" effect during the twisting of the skein. Misalignment of the spinning needle will cause fretting to occur at the root 96' of the spinner needle and the wire will become work-hardened and the needle will wear.

Figure 7:
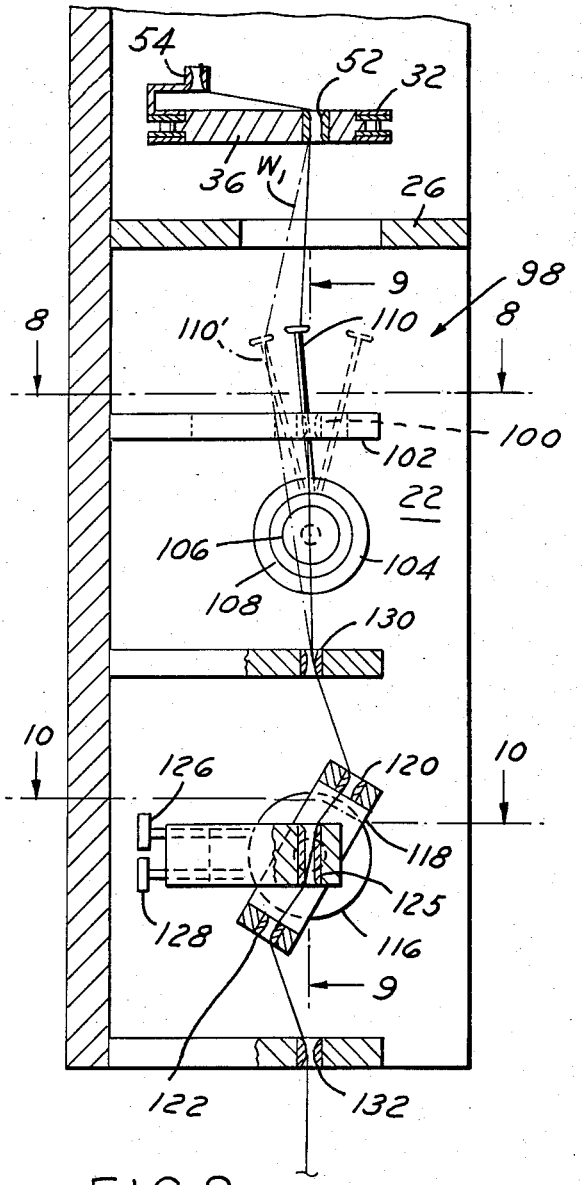
FIG. 7 is a front elevation of a filament take-up mechanism and a filament tensioning mechanism.
Figure 9:
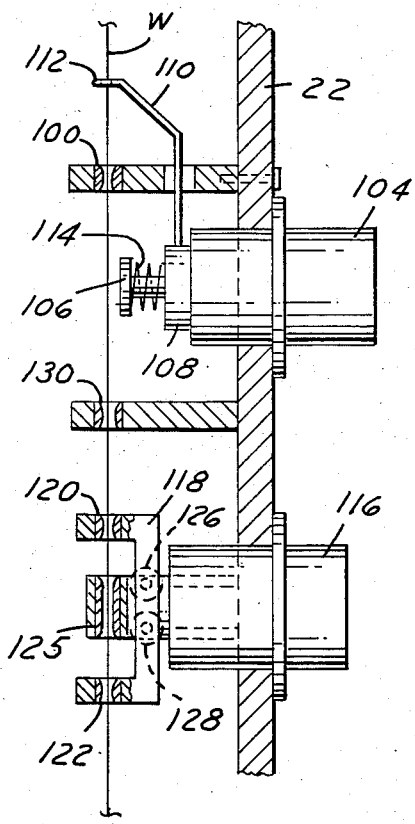
FIG. 9 is a cross-sectional view taken on a line 9—9 of FIG. 7.
Figure 8:
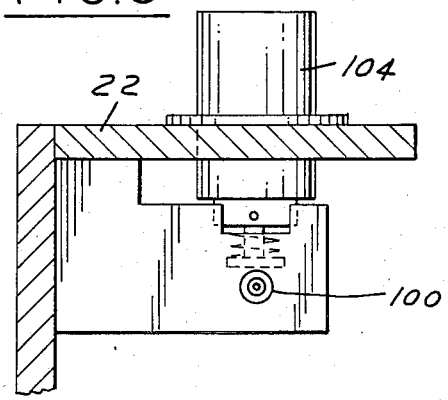
FIG. 8 is a cross-sectional view taken on a line 8—8 of FIG. 7.

To eliminate slack which is unavoidably introduced during looping the filament on the needles, an improved filament take-up device is provided having a low moment of biasing effect of a stalled DC motor. This is shown in FIGS. 7–9 where the take-up mechanism 98 comprises a pair of spaced apart wire guides 52 and 100, the former constituting the wire source eyelet in the guide plate 36. Eyelet 100 is mounted on a shelf 102 supported on the end wall 22 of the skeiner housing. A 12-volt DC motor 104 is mounted on wall 22 and on the end of the motor shaft is mounted for fixed rotation therewith a driving hub 106. Mounted on the motor shaft to rotate relative thereto, is a take-up arm hub 108 made of a lightweight material such as aluminum to which is affixed a take-up arm 110 having an eyelet 112 at its upper end. A lightweight coil spring 114 is connected at opposite ends to the hubs 106 and 108. Upon energizing motor 104, the hub 106 will tend to rotate and through tensioning of spring 104 will tend to shift the take-up arm 110 in one direction or the other toward the phantom outline positions shown in FIG. 7.

In operation, during coil winding when wire take-up is not required, motor 104 may be de-energized so that the take-up arm 110 will effectively float on the wire as it moves through the guides 100 and 52. When, however, skeining is to be effected, motor 104 is energized and imposes a bias on the wire and when slack therein occurs during the looping action the take-up arm may move to the phantom outline position 110' to deflect the wire to the position W' shown in phantom outline in FIG. 7. Because the mass of the motor armature is removed from the take-up action and only the mass of the arm 110 and the tension of spring 114 must be overcome, the wire is not stressed as much during the take-up action and as a consequence the speed of wire feed during looping on the needles may be materially increased.

The motor 104 can be used in a stalled condition to provide the necessary tension on the take-up arm 110 to suit the wire diameter being skeined. The use of motor 104 provides the following features: (1) the take-up arm can be adjusted remotely and consistently; (2) the motor can be switched off during coil winding or part of the skeining process for the purpose of providing a straight path for the wire during high acceleration periods; and (3) the power to this motor can be preset, raised or lowered gradually to provide the desired take-up characteristics to suit a range of wire sizes, or can be coordinated with the looping eyelet movement to give greater or less bias during predetermined portions of eyelet travel.

For example, an inductive detector 136 in close proximity to the looping eyelet chain 32 cooperable with a peg 137 on the chain may switch "ON" the take-up motor 104 as the wire is passing around the spinner hook, and the take-up motor would remain on until the wire is carried around the rear locus adjacent the filament source eyelet 52, and at this point the motor may be switched "OFF" and the wire being drawn forward past the rear hook would pull the de-energized arm forward, thus minimizing the strain shock on the wire during its rapid acceleration as it is looped on needle 68.

It has been found that providing a wire take-up mechanism of the type herein disclosed, in combination with relocation of the root of the spinner needle as described in connection with FIGS. 1–6 and/or a modification in the track or locus of the looping eyelet as shown in FIG. 6, skeining speeds up to twice that obtained in the prior art or in the mechanism shown in application Ser. No. 633,845 filed July 24, 1984, is possible.

Figure 10:
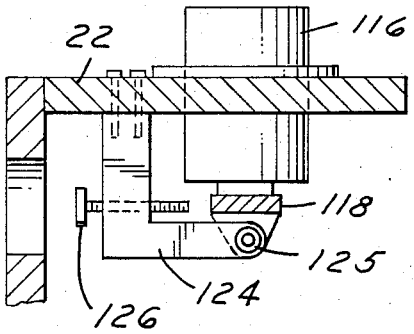
FIG. 10 is a cross-sectional view taken on the line 10—10 of FIG. 7.

Wire tensioning means is shown in FIGS. 7, 9 and 10 which may provide several wire tensioning conditions. The tensioner comprises a spaced apart pair of ceramic ferrules or eyelets 130 and 132 mounted on shelves 134 and 136 which are secured to the end wall 22 of the skeiner housing. A DC electric motor 116 similar to the motor 104 is also mounted on the end wall 22. On the shaft of motor 116 is mounted a U-shaped bracket 118 carrying a pair of spaced apart ceramic ferrules or eyelets 120 and 122, such that upon energization of the motor 116 the bracket 118 is rotated to shift the eyelets 120 and 122 into angularly displaced positions. An L-shaped bracked 124 fastened to the wall 22 of the housing carries an elongated ferrule 125 which is aligned with the stationary ferrules 130 and 132. Biasing of the bracket 118 to an angularly displaced position will cause the wire to follow a tortuous path through the tensioner. A pair of adjustable stop screws 126 and 128 are mounted in the L-shaped bracket for the purpose of limiting angular displacement of the ferrules 120 and 122 in either direction of rotation of the bracket.

The various wire tensioning conditions that this tensioning mechanism provides are as follows:

(1) Upon de-energization of motor 116 the bracket 118 may assume a position in which the eyelets 120 and 122 are aligned with the eyelets 130 and 132 and the elongated ferrule 125 whereby the wire may pass directly through the tensioner without having any tension imposed thereupon.

(2) By adjusting stop screw 128 so that it projects more closely toward the bracket 118 than does stop screw 126, and then energizing the motor 116 in one direction or the other, the angular displacement of the bracket and, in turn, the eyelets 120 and 122, may be given two preset positions and accordingly two different sets of tension.

(3) By varying slightly the voltage across the motor 116, a bias may be imposed on the bracket 118 and, in turn, the eyelets 120 and 122, to vary the tension between a condition of no tension and a condition where one of the stop screws limits further displacement of the bracket.

Figure 11:
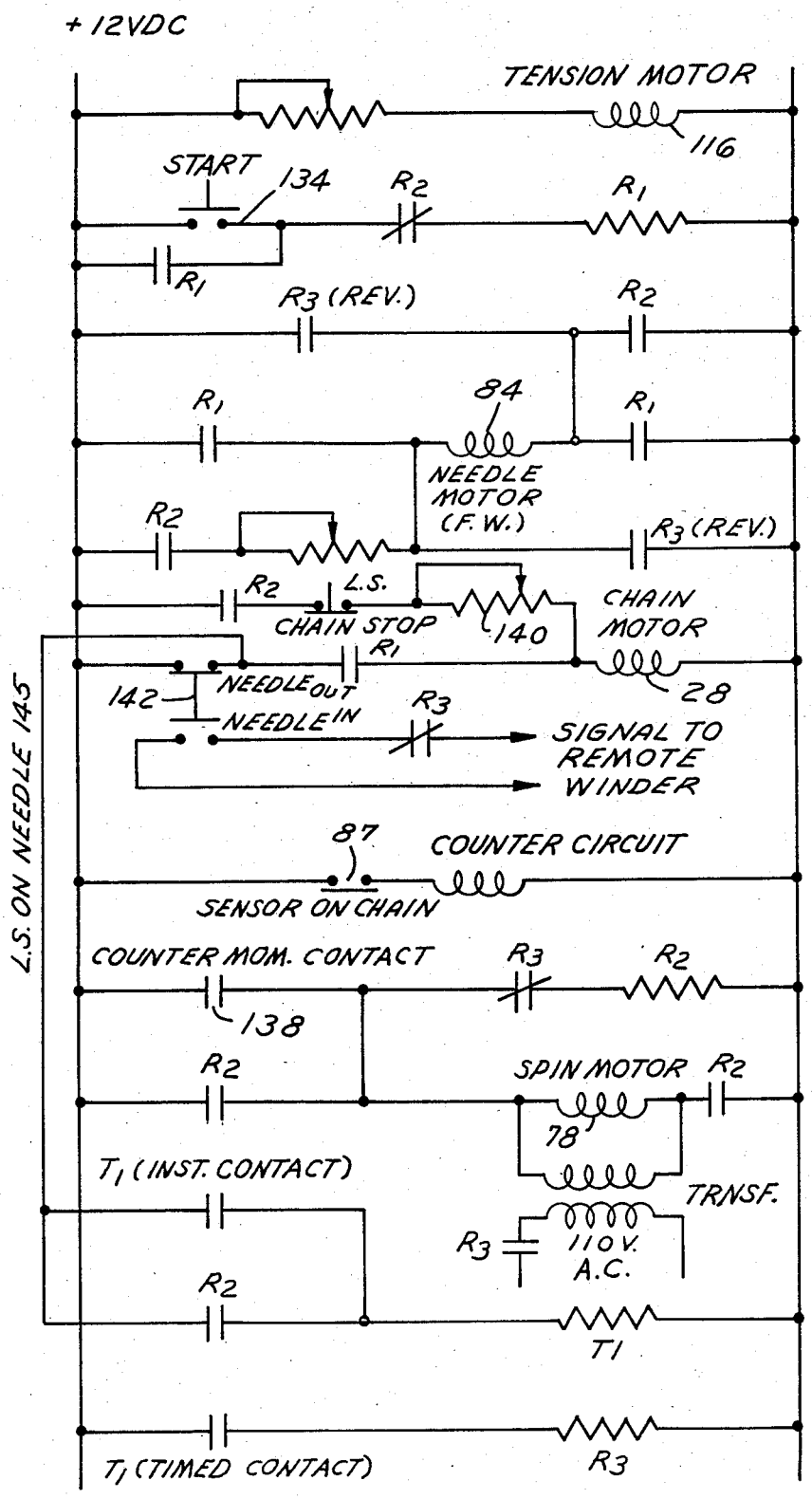
FIG. 11 is an electric schematic of the control and power circuitry for the skeining mechanism of FIG. 1.

FIG. 11 shows an electric schematic of the control circuit for the skeiner and may best be described in reference to the operation of the skeiner. The circuit is connected to a source of 12-volt DC and to a source of 50–60 cycle 110-volt current as hereinafter described. The circuit is started by a start switch 134 which is momentarily closed as by a coil winder remote from the skeiner upon completion of a given number of windings on the coil. Upon closure of switch 134, relay $R_1$ closes and holds in to contact $R_1$. Contact $R_1$ also closes the circuit to the needle motor 84 which drives the needle 68 outwardly and in the counterclockwise direction as previously described, where it stops substantially in the position shown in FIG. 2. Also, relay $R_1$ starts the chain motor 28 which makes a set number of turns. A sensor 136 mounted adjacent the chain senses chain revolutions and a counter-circuit closes momentarily at a set point, the counter momentary contacts being indicated at 138 in FIG. 12.

Upon momentary closure of contacts 138, $R_2$ is energized, which drops out relay $R_1$ through the normally closed contact $R_2$. $R_2$ also puts regulated power forward on the needle motor 84 to bias it with a predetermined angular bias (which may be overcome as the skein is twisted to permit the shortening of the skein by the clockwise pivoting of the needle 68). Also, relay $R_2$ starts the spin motor 78 and initiates the timing circuit $T_1$. $R_2$ contacts continue to provide a voltage to chain motor to move it to its stopping position at a lower speed through the voltage control 140, the chain finally stopping when LS is opened.

Timer $T_1$ is held in through instantaneous contact $T_1$ when timer $T_1$ times out (which would be in ½ to 3 seconds), timed contact $T_1$ closes to energize relay $R_3$ which drops out $R_2$ to stop the spin motor 78. To set the spin motor in permanent magnet position to locate the needle 66 in its proper downward position, relay $R_3$ closes an AC circuit to a transformer which steps down the voltage to 12 volts, and this is impressed across the motor windings. The alternating current force overcomes any resistance in the drive belt 74 and associated bearing friction and forces the needle 66 to assume the correct position.

Relay $R_3$ contacts also close to reverse the needle motor 84 and retract the second needle 68. A limit switch 142 is operated when the needle 68 has been retracted, and this opens the circuit to timer $T_1$ and sends a signal to the winder to continue the winding operation and pull the wire and skein out of the skeiner.

I claim:

1. In a skeining machine having a looping member arranged to move in an elongated endless track having recurvate ends, and a pair of looping needles arranged within said path to have a filament looped thereon during revolution of the looping member about the path, one of said needles being a spinner needle mounted on a rotatable shaft at an acute angle extending away from the outer needle, and the spinner needle being disposed adjacent one of said recurvate ends of the looping member path, the invention characterized by the root of the connection between the spinner needle and the rotatable shaft being disposed between the path of movement of the looping member and the center of recurvature of the looping member path.

2. The invention defined in claim 1 wherein the root of the connection between the spinner needle and the rotatable shaft is disposed closer to the center of recurvature than to the path of looping member movement.

3. The invention defined in claim 1 wherein a filament source eyelet is provided adjacent the other recurvate end and is disposed in alignment with the looping element path and displaced from the centerline extending between the centers of recurvature of the looping member path ends.

4. The invention defined in claim 3 wherein the filament source eyelet is displaced to the opposite side of the centerline extending between the centers of recurvature ends of the looping member path from the other of said needles.

5. The invention defined in claim 3 wherein the root of the spinner needle and its rotatable shaft is displaced to the opposite side of the centerline extending between the recurvate ends of the looping member path.

6. The invention defined in claim 5 wherein the displacements of the root of the spinner needle and the filament source eyelet from the centerline extending between the recurvate ends of the looping member path are equal.

7. The invention defined by claim 3 wherein the filament source eyelet is in alignment with the path of travel of the looping element and located at a position before the looping element crosses the centerline extending through the centers of recurvature of the ends of the looping member path.

8. The invention defined by claim 1 wherein the radius of curvature of the opposite ends of the looping member path is dissimilar.

9. The invention defined by claim 8 wherein the radius of curvature of the recurvate end of the path of the looping member adjacent the spinner needle is less than the radius of the opposite recurvate end of the path of the looping member.

10. The invention defined in claim 1 wherein the looping member is mounted on an endless flexible drive element extending around an elongated track having recurvate ends, and drive means for the endless drive element disposed intermediate the recurvate ends of the track and engaging both of said oppositely moving spans to drive said element.

* * * * *

UNITED STATES PATENT AND TRADEMARK OFFICE

CERTIFICATE OF CORRECTION

PATENT NO. : 4,632,156

DATED : December 30, 1986

INVENTOR(S) : GEOFFREY E. WHELLAMS

It is certified that error appears in the above-identified patent and that said Letters Patent is hereby corrected as shown below:

In column 8, line 29, change the word "outer" to --- other --.

Signed and Sealed this

Seventh Day of April, 1987

*Attest:*

DONALD J. QUIGG

*Attesting Officer*

*Commissioner of Patents and Trademarks*